US007358855B1

(12) United States Patent
Willis

(10) Patent No.: US 7,358,855 B1
(45) Date of Patent: Apr. 15, 2008

(54) LOCAL AREA WARNING SYSTEM (LAWS)

(75) Inventor: Robert Willis, Mansfield, TX (US)

(73) Assignee: Maxillis, Ltd., Mansfield, TX (US)

( * ) Notice: Subject to any disclaimer, the term of this patent is extended or adjusted under 35 U.S.C. 154(b) by 230 days.

(21) Appl. No.: 11/145,618

(22) Filed: Jun. 6, 2005

(51) Int. Cl.
*G08B 1/08* (2006.01)

(52) U.S. Cl. ..... 340/539.28; 340/332; 340/539.22; 340/539.26; 340/601

(58) Field of Classification Search ..... 340/539.1, 340/601, 539.17, 690, 539.22, 331, 539.26, 340/332, 539.28, 286.11, 384.1, 384.4; 40/573; 455/404.1; 702/3; 73/170.16
See application file for complete search history.

(56) References Cited

U.S. PATENT DOCUMENTS 3,749,982 A * 7/1973 Derdzinski et al. ..... 361/616
4,736,186 A * 4/1988 Jones ..... 340/331
5,121,430 A * 6/1992 Ganzer et al. ..... 380/258
5,133,081 A * 7/1992 Mayo ..... 455/18
5,444,433 A 8/1995 Gropper
5,755,174 A 5/1998 Freeman
5,781,852 A * 7/1998 Gropper ..... 455/227
5,952,919 A * 9/1999 Merrill ..... 340/539.18
6,121,885 A 9/2000 Masone et al.
6,177,873 B1 1/2001 Cragun
6,204,761 B1 3/2001 Vanderable
6,295,001 B1 9/2001 Barber
6,462,665 B1 10/2002 Tarlton et al.
6,710,715 B2 3/2004 Deeds
6,867,688 B2 3/2005 Lamb
7,114,169 B1 * 9/2006 Kahn ..... 725/33
2002/0024437 A1 * 2/2002 Neer ..... 340/540
2002/0075155 A1 6/2002 Guillory
2002/0080038 A1 6/2002 Smith
2002/0097161 A1 7/2002 Deeds
2002/0107032 A1 * 8/2002 Agness et al. ..... 455/456
2003/0151591 A1 8/2003 Harpen et al.
2003/0179089 A1 9/2003 Sweatt
2003/0193394 A1 10/2003 Lamb
2004/0181404 A1 9/2004 Shedd
2005/0057342 A1 3/2005 Haynes

* cited by examiner

*Primary Examiner*—Brent A. Swarthout
(74) *Attorney, Agent, or Firm*—Carr LLP

(57) ABSTRACT

The present invention provides a local area warning system that is designed to alert the public of severe weather and technological alerts. The apparatus consists of red, amber, and blue warning lights and audio speakers that warn the public of the severe conditions. The speakers can be employed to produce a loud siren and/or coherent broadcasts describing the severe condition. An antenna on the apparatus captures the radio frequency broadcast signal from NWR. A receiver connected to the antenna decodes and presents the audio and visual messages of weather and technological conditions to the public through the warning lights and the speakers. The county code or the geographical location is entered into the receiver such that only severe alerts that correspond to the area of the device will be presented. All of these components are connected to a support structure.

3 Claims, 10 Drawing Sheets

200

| | NORMAL AUDIO ON-DEMAND | TORNADO WATCH | TORNADO WARNING | SEVERE THUNDERSTORM WATCH | SEVERE THUNDERSTORM WARNING | FLOOD WATCH | FLOOD WARNING |
|---|---|---|---|---|---|---|---|
| REDUCED VOLUME AUDIO | YES | | | | | | |
| AMPLIFIED AUDIO | | YES | | YES | YES | | |
| AMPLIFIED AUDIO W/ALERT SIREN | | | YES | | | | |
| RED STROBE | | | YES | | YES | | YES |
| AMBER STROBE | | YES | | YES | | | |
| BLUE STROBE | | | | | | | |
| GREEN STROBE - SAFE AREA | | | YES | | YES | | YES |

PURCHASED BY: XYZ MOBILE HOME PARK

LOCATION (CITY, COUNTY, STATE): FORT WORTH, TARRANT CO., TEXAS

*FIG. 8*

LOCAL AREA WARNING SYSTEM (LAWS)

FIELD OF THE INVENTION

The present invention relates generally to a local area warning system, and more particularly, to an apparatus that is designed to receive and decode radio broadcasts and provide notification of severe weather events, as well as other civil alerts, to the public in environments where the public is at risk.

DESCRIPTION OF THE RELATED ART

The National Oceanic and Atmospheric Administration ("NOAA") operates a NOAA weather radio ("NWR"), which is a nationwide network of radio stations broadcasting continuous weather information. NWR broadcasts National Weather Service ("NWS") warnings, watches, forecasts, and other hazard information 24 hours a day. Through the use of current technology the NWS can accurately predict future weather events. The NWS has regional offices covering all 50 states and the adjacent coastal waters. Therefore, the weather broadcasts can provide severe weather warnings, watches, and statements to specific geographical regions. By integrating the Federal Communication System ("FCC") Emergency Alert System ("EAS"), the NWR broadcasts warnings and post-event information for all types of hazards—both natural and technological, as well as civil emergency messages such as the AMBER (America's Missing: Broadcast Emergency Response) alerts. The NWR is an "all hazards" radio network, making it a single source for the most comprehensive weather and emergency information available to the public.

Currently, weather messages are continuously broadcast through a radio signal on the VHF band at seven frequencies between 162.400 and 162.550 MHZ, which is outside the standard broadcast AM and FM frequencies. Special radio receivers are required to pick up these frequencies within a range of 40-50 miles from a NOAA transmitter. The weather broadcasts contain regional weather information that is updated periodically, and other alert messages as necessary. Some of these special radios are simple, passive receivers which require user interaction to receive a message or alarm. Other weather radios detect these severe warnings and sound a local alarm on the receiver indicating that a weather alert has been issued. The user can then listen to the alert message by turning on the radio and picking up the signal, or this can be done automatically as a function of the receiver.

The NWR provides an advanced alerting system known as Specific Area Message Encoding ("SAME"). A device with the SAME technology is capable of receiving, decoding, and presenting, through optional aural and visual mechanisms, the weather alerts provided by the NWR. With the "all hazards" radio, the public can be warned of any impending disaster by the NWR, as well as other alerts of civil importance. The SAME system uses digital decoding to broadcast alerts in geographically specific areas. A sample product that employs this SAME technology is the "RadioShack 7-Channel Weatheradio with NWR-SAME Severe Weather Alert," which provides weather warnings to the public. This radio receives and processes the signals from NWR for selected counties. The user enters her county into the radio by programming a six-digit code.

These types of small radios are only designed to provide weather or technological alerts to an individual or a household. Accordingly, an individual has to purchase this type of a device to receive the warnings provided by NWR. Other conventional options of warning the public include blaring air-raid type sirens that do not normally provide any specifics about the type of weather or technological warning. Furthermore, these siren systems almost always require a local authority to initiate the alarm, increasing the likelihood of error or lack of timeliness. Sirens of this type are also relatively expensive and have proven to be cost prohibitive for many applications. Severe weather or technological warnings are provided through radio or television, but normally a radio station or a television station broadcasts to a large geographical area. Therefore, the warning information provided may not apply to a specific county. Televisions and some radios cannot be used if severe weather has disrupted power to that area. Furthermore, many areas where the public is potentially vulnerable are not well suited to television reception, and broadcast band radios may not be adequate to spread an alert message.

A system which can accurately provide these detailed weather or technological warnings to a relatively large number of people is needed. The public should be able to receive these kinds of alerts in a variety of places, such as parks, lakes, golf courses, mobile home parks, industrial areas and the like, without having to purchase a personal weather radio.

SUMMARY OF THE INVENTION

The present invention provides a local area warning system that is designed to warn the public of severe weather alerts, technological warnings, and civil alert statements as broadcast by NWR. The invention is designed to be utilized primarily outdoors as an innovative bridge between personal alert devices and large/costly air-raid sirens. The apparatus consists of multiple warning lights that visually warn the public of severe weather or technological conditions. The multiple warning lights are different colors so that the public can determine the severity of the weather or technological condition. The warning lights may be high-intensity flashing lights of three different colors, such as red, amber and blue. Red shall be reserved for events which pose an immediate danger to life, health or property. Ideally, the warning thresholds and related color warning/watch schemes should be standardized by the NWS and explained by signage in the area of the apparatus. One or more speakers also warn the public of severe weather or technological conditions. These speakers can be employed to produce a loud siren and/or verbal broadcasts describing the severe condition. The public should be able to approach the apparatus and manually activate the system to listen to the audible radio broadcast at a reduced volume if necessary. The audio speakers can be programmed to emit a distinctive, amplified alarm signal for a defined duration, and then broadcast an amplified message relevant to the specific condition. Accordingly, the proper signage is necessary to inform the public of the features of the local area warning apparatus and the corresponding procedures.

An antenna on the apparatus captures the radio frequency broadcast signal from NWR. A receiver connected to the antenna decodes and presents the messages of weather and technological warnings to the public through the warning lights and the speakers. Now that the NWR broadcasts an "all hazards" programming, the receiver can be designed to decode only specific NWR broadcasts. In a preferred embodiment, this receiver utilizes the SAME technology. The receiver only broadcasts alerts for severe conditions, as defined by the user, in the area of the device. The county code or the geographical location is entered into the receiver such that only pre-determined statements that correspond to the area of the device will be presented. The response of the receiver should be user selectable utilizing the aural and visual signals to the appropriate advantage of the application. This apparatus should be connected to a power supply that can provide power to the apparatus even when a public power supply is unavailable. In addition, the apparatus should be housed on a sturdy structure and the components should be protected such that severe weather or human tampering does not affect the operation of this apparatus.

This apparatus is engineered to be placed, and operate in environments where the public is typically most at risk, outdoors. This apparatus should be mounted in a conspicuous position to take advantage of visibility, audibility, and protection from vandals. Consideration should also be taken to ensure that the antenna can receive the VHF-FM NWR broadcasts. This apparatus can be installed in public parks, beaches, city areas, mobile home parks, golf courses, residential neighborhoods, and the like. Accordingly, in these environments the local area warning apparatus should be adequately large in size such that the largest group of people can be warned. Some applications will likely require multiple apparatuses. This apparatus can also be employed as a small mobile device. A mobile local area warning apparatus can be used for applications such as boating trips and construction job sites.

Another embodiment of the present invention is a similar warning apparatus with only one green light. This apparatus can be placed at a shelter or a safe area to direct potential victims to a pre-determined area of safety. This apparatus may also be enhanced with an audible tone in conjunction with the green light to help those that are visually impaired. The green light should only flash when it truly indicates a safe haven, such as high ground for a flood or an underground shelter for a tornado. Once again, the proper signage is necessary to alert the public of the purpose of this apparatus.

BRIEF DESCRIPTION OF THE DRAWINGS

For a more complete understanding of the present invention and the advantages thereof, reference is now made to the following descriptions taken in conjunction with the accompanying drawings, in which:

FIG. 8 is an example of a local area warning system programming matrix.

DETAILED DESCRIPTION

In the following discussion, numerous specific details are set forth to provide a thorough understanding of the present invention. However, those skilled in the art will appreciate that the present invention may be practiced without such specific details. Additionally, for the most part, details concerning network communications, and the like, have been omitted inasmuch as such details are not considered necessary to obtain a complete understanding of the present invention, and are considered to be within the understanding of persons of ordinary skill in the relevant art.

Figure 1:
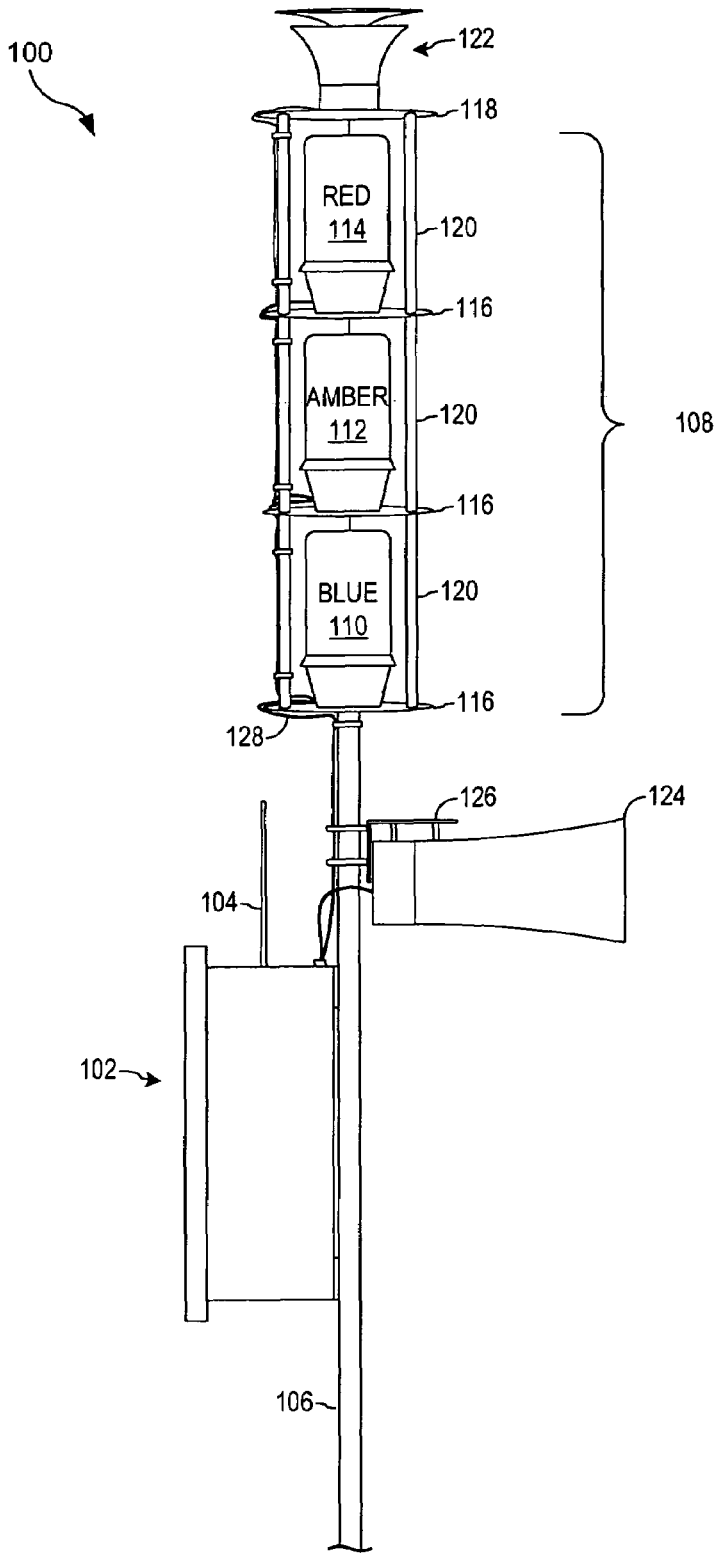
FIG. 1 is a local area warning apparatus that contains an antenna, an electronics package, visual warning devices, and audio warning devices.

FIG. 1 is a local area warning apparatus 100 that contains an antenna, an electronics package, visual warning devices, and audio warning devices. A support 106, such as a pole is the backbone for the apparatus 100 and is anchored in the ground. A receiver/electronics package ("box") 102 is connected to the pole. An antenna 104 receives the radio frequency (RF) broadcasts from NWR. In another embodiment, the antenna 104 receives broadcasts from any broadcasting service that applies to a specific geographic location. Accordingly, the antenna 104 provides the broadcast signals to the receiver/electronics package 102. Care should be taken so that the antenna 104 can receive the VHF-FM NWR broadcasts. The specifics of the receiver/electronics packages 102 are described in further detail with reference to FIG. 6. The box 102 storing the receiver/electronics circuitry must be strong and weather-proof. The box 102 should be able to withstand torrential rains, high winds, lightning, and any human tampering. Accordingly, the box should be a National Electrical Manufacturer's Association ("NEMA") listed enclosure. In a preferred embodiment, the box 102 should have a strong locking mechanism so that authorized individuals can test or repair the circuitry if necessary. The antenna 104 and the receiver electronics circuitry need to be connected to a power source.

At one end of the support 106 is a set of electronic color-coded visual warning lights 108. These warning lights 108 can be located anywhere on the support 106, but in this embodiment the warning lights 108 are placed on the top of the support 106 so that the lights can be seen by the public at the greatest distance away from the apparatus 100. Accordingly, the warning lights 108 should be placed as high as possible. The strength of the support 106, the type of severe weather in that area (for example high winds), and the height of surrounding buildings or landscape should all be factors in determining the placement and height of the warning lights 108.

The warning lights 108 contain three separate lights of different color. Warning light 114 is red, warning light 112 is amber, and warning light 110 is blue. In a preferred embodiment, these warning lights 108 are high powered strobe lights designed to catch the attention of the public. Red warning light 114 signifies an event that poses immediate danger to life, health, or property. The red warning light 114 will illuminate in situations such as a tornado warning, a hurricane warning, or a severe technological warning. Amber warning light 112 indicates an event that the public should be cautious about. The amber warning light 112 will illuminate in situations such as a tornado watch, a hurricane watch, or a severe thunderstorm. Blue warning light 110 signifies an event that the public should be informed about, but does not pose an immediate risk to the public. Blue warning light 110 will illuminate in situations such as terrorist threats, AMBER alerts, and distant weather or technological threats. Accordingly, the red warning light 114 is placed higher than the other lights because it indicates an event the provides the most immediate threat to the public. Ideally, the warning thresholds and related color warning/watch schemes should be standardized by the NWS.

The audio warnings are provided by speakers. In one embodiment, an omni-directional speaker 122 is located at the top of the warning lights 108, and one directional speaker 124 is located below the warning lights 108 on the support 106. The placement of the directional speaker 124 can be anywhere on the lower part of the apparatus 100, although care should be taken that the speaker 124 does not obscure the view of the warning lights 108. The directional speaker 124 is attached to the support 106 by a mounting bracket 126. The omni-directional speaker 122 should be powerful so that it can be heard throughout a large area. The directional speaker 124 should have the ability to operate at a lower volume. Accordingly, the omni-directional speaker 122 can provide the loud warning alarm or siren, and the directional speaker 124 can provide the audible specifics of the weather alert. The directional speaker 124 should be able to be approached by individuals that wish to hear the specifics of the severe weather or other condition. In an embodiment, the audible specifics of the broadcast should be able to be manually activated. Both speakers 122 and 124 need to be connected to a power source. An amplifier (not shown) for the speakers resides within the box 102. Additionally, consideration should be given to the acoustic characteristics of the area of installation and the speakers should be positioned and designed accordingly. This configuration of the speakers is only presented to describe one embodiment of the present invention, and does not limit the present invention to this embodiment.

The warning lights 108 are housed on a group of mounting plates 116. Each of the warning lights 110, 112, and 114 are secured on these mounting plates 116. A high-impact/UV radiation shield 118 is secured above the red warning light 114. The omni-directional speaker 122 is attached to the high-impact shield 118. The high-impact shield 118 protects the warning lights 110, 112, and 114 and must be able to withstand the elements, such as wind, rain, hail, and sunlight. Vertical supports 120 provide the support for the warning lights 108 by connecting all three mounting plates 116 and the high-impact shield 118. In a preferred embodiment, there are three separate vertical supports 120 attached at 120° apart. The circular mounting plates 116 provide the full 360°. The vertical supports 120 should be strong, but also very thin. These supports 120 should be thin so that the view of the warning lights 108 is not obstructed. In another embodiment, the warning lights 108 are housed in a NEMA intrinsically safe enclosure. An electric cable 128 is attached to one of the vertical supports 120 to provide electrical power to the warning lights 110, 112, and 114, and the speakers 122 and 124.

There must be signage along with this local area warning apparatus 100. Preferably, a conspicuous, large sign is used to describe the features of the apparatus. The colored warning lights (red, amber, and blue) should be fully explained. The types of events or conditions that cause each light to illuminate, the safety procedures that correspond to each warning light, and the audible alarm system should be described in detail. This way the public can understand the features of this apparatus 100 and respond accordingly. Furthermore, the local area warning apparatus 100 should be tested periodically. In a preferred embodiment, there is a protocol to test the speakers 122, 124, the warning lights 114, 112, 110, and the receiver/electronics package 102.

The size of the local area warning apparatus 100 can be adjusted for any implementation. A small apparatus 100 can be used in places like a shopping mall or on a job site. A small apparatus 100 can also be mobile, which would allow a construction crew to travel with the apparatus to multiple job sites. A large apparatus 100 can be used in places like a public beach, a public park, a mobile home park, or a golf course.

As previously stated, the volume of the aural message of the local area warning apparatus 100 should be adapted to the specific application. In this example, the effective audible distance can be based upon a 70 decibel ("dB") threshold. A 100 Watt ("W") directional speaker can be heard at 60-68 dB at 100 yards in radio broadcast mode. In alarm mode the 100 W directional speaker delivers 80 dB at 100 yards. An omni-directional speaker delivers 78 dB at a 100 yard radius about the apparatus 100. These numbers can be improved with specific engineered enhancements. The volume of the speakers for this apparatus 100 can be adjusted based upon the application. Accordingly, an apparatus 100 at a golf course should be able to be heard by the public at a greater distance than 100 yards.

Figure 2:
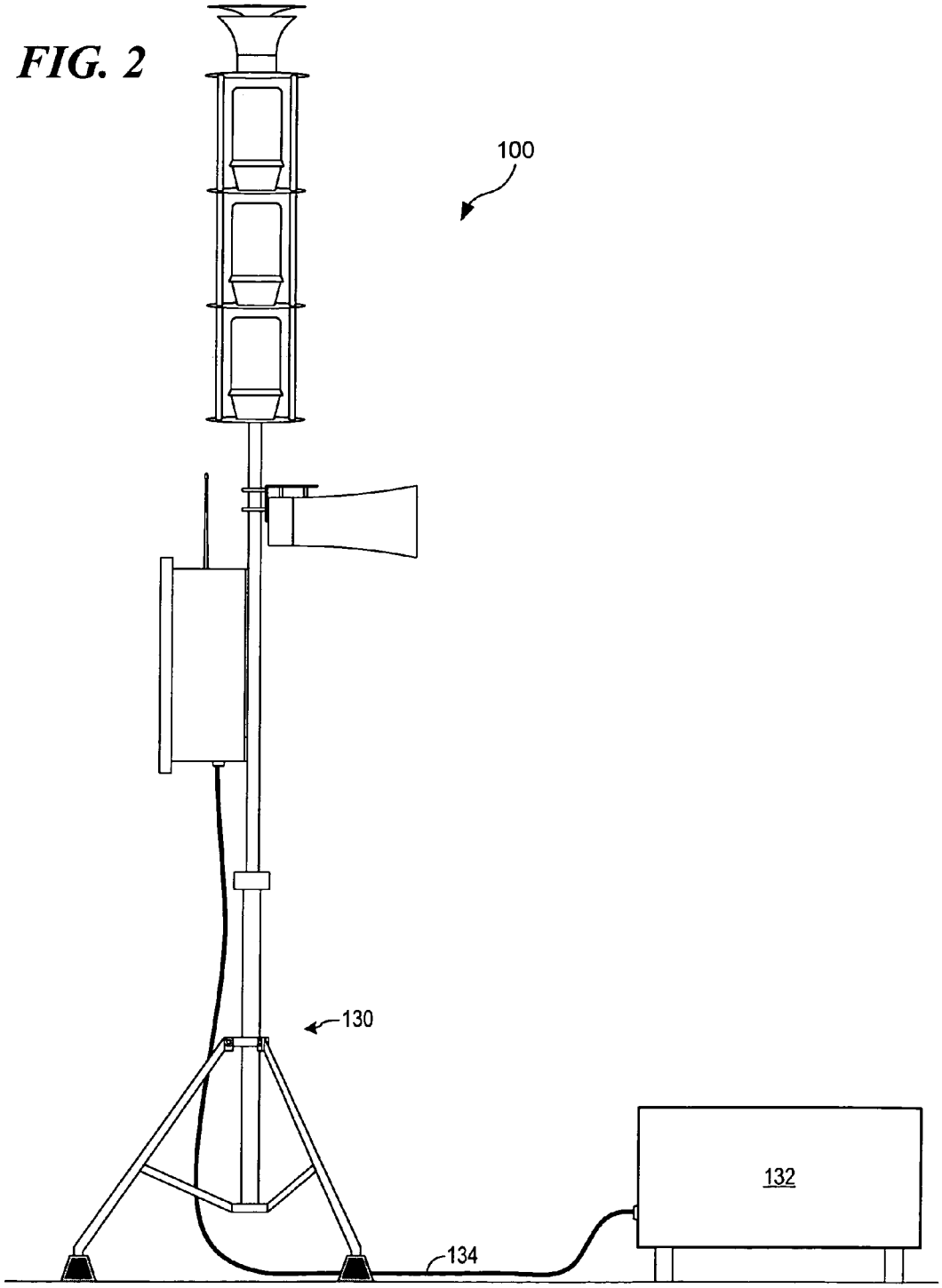
FIG. 2 is the local area warning apparatus on a tripod stand connected to a power supply.

FIG. 2 is the local area warning apparatus 100 on a tripod stand connected to a power source. The tripod 130 provides the support for the local area warning apparatus 100. A power source 132 is connected to the receiver/electronics package 102 through an electrical cord 134. The power source 132 provides the electrical power needed to operate this apparatus 100. Accordingly, the power source 132 would directly or indirectly be connected to the components in the receiver/electronics package 102, the speakers 122 and 124, and the warning lights 110, 112, and 114. In a preferred embodiment, the power source 132 has a connection to a public power supply, but also has the ability to operate when the public power supply is unavailable. The use of power sources will be described in further detail with reference to FIGS. 7A, 7B, 7C, and 7D.

A tripod 130 is not the ideal means of support for this apparatus 100, but it is only provided as an example of one implementation. There are many different means of support for this apparatus 100. The support 106 can be attached to the top of a building or a communication pole, such as a telephone pole. The support 106 can also be replaced by a more stable tower configuration, as described with reference to FIG. 4.

Figure 3A:
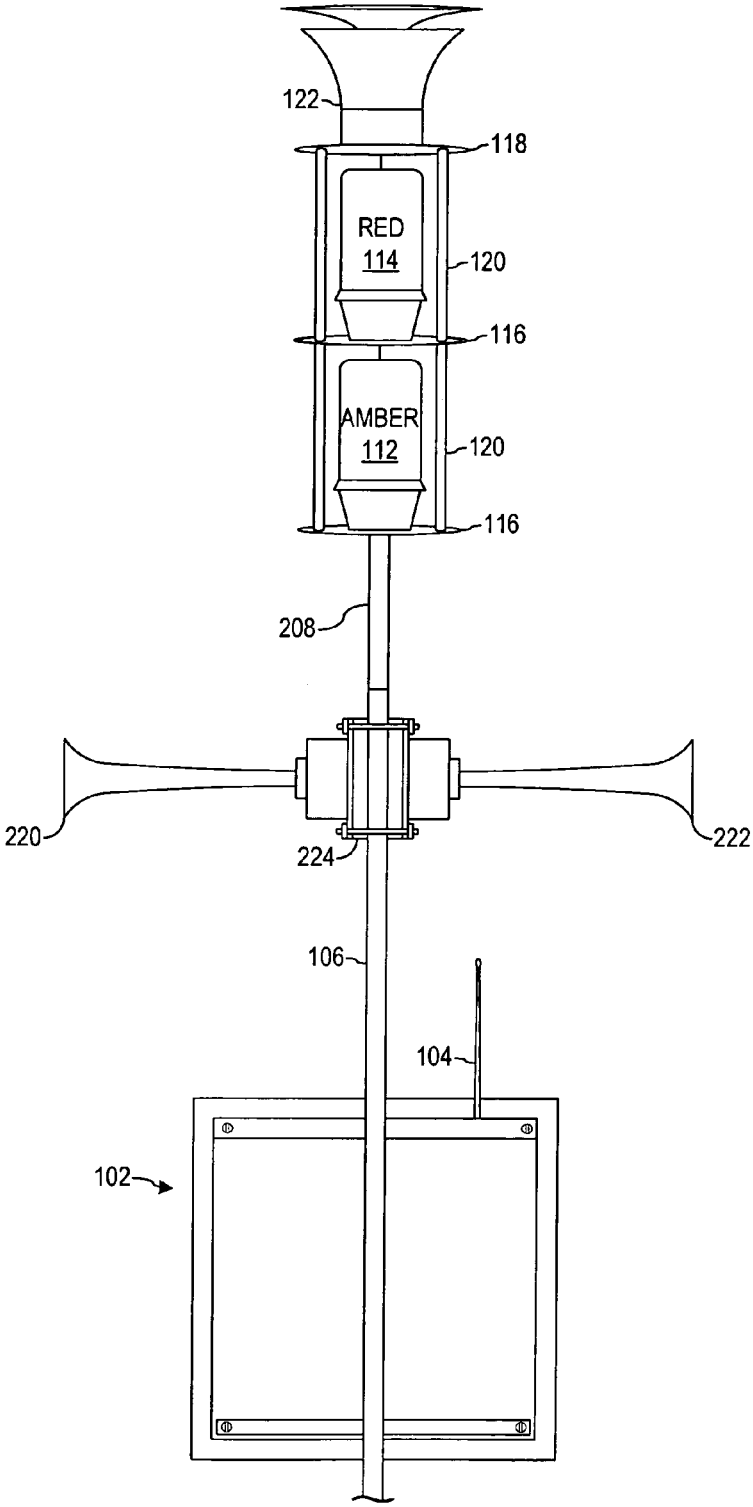
FIG. 3A is an alternative embodiment of the local area warning apparatus with two warning lights.

FIG. 3A is an alternative embodiment of the local area warning apparatus with two warning lights 200. This embodiment contains two warning lights, red light 114 and amber light 112. The blue warning light 110 from FIG. 1 has been removed in this embodiment. This embodiment is utilized to receive the NWR broadcast. Accordingly, this apparatus 200 can be programmed to only react to weather conditions. If technological warnings are not an issue, then this embodiment may be the best option. Programming this apparatus will be described in further detail with reference to FIG. 8. Two warning horns 220 and 222 are attached to support 106 by a mounting bracket 224. The warning horns 220 and 222 are placed at 180° apart from each other about the support 106. The rest of the features of this embodiment are described in detail with reference to FIG. 1.

Figure 3B:
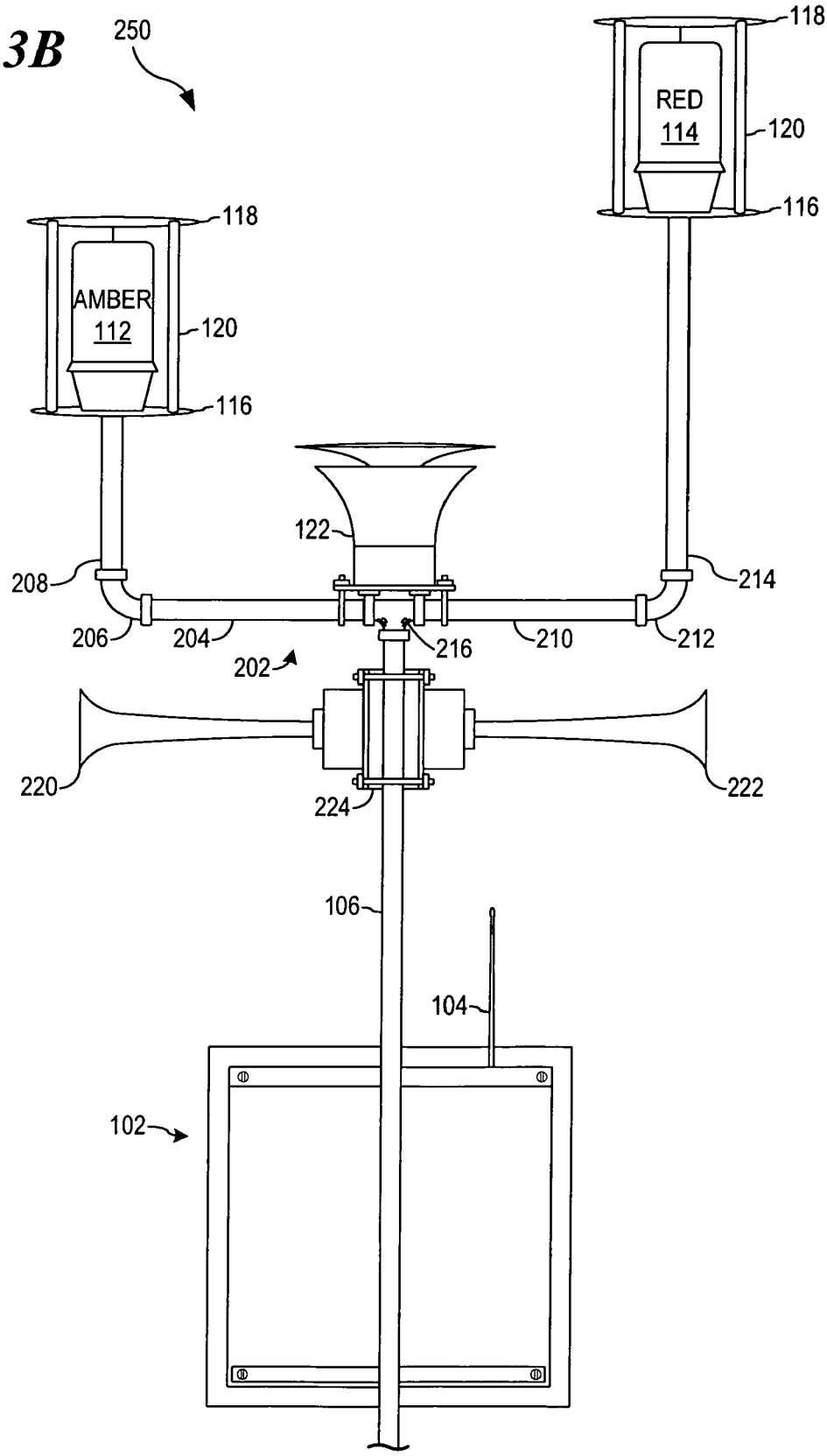
FIG. 3B is an alternative embodiment of the local area warning apparatus with a crossbar configuration of the two warning lights.

FIG. 3B is an alternative embodiment of the local area warning apparatus 250 with a different configuration of the two warning lights. This embodiment contains two warning lights, red light 114 and amber light 112. As previously described, the blue warning light 110 of FIG. 1 has been removed in this embodiment. These lights 114 and 112 are placed at separate heights so that neither light is obscured by the other light. Each of the lights 114 and 112 are supported by hail-impact/UV radiation shield 118, a mounting plate 116, and the vertical supports 120. The receiver/electronics package 102 is mounted to the support 106. The antenna 104 is attached to the receiver/electronics package 102. The configuration of these components is described in detail with reference to FIG. 1.

A tee-coupler 216 is connected to the support 106. A first horizontal bar 204 and a second horizontal bar 210 are connected to the tee-coupler 216. The first horizontal bar 204 is connected to a right-angle coupler 206, which is connected to a first vertical bar 208 that provides support for the amber warning light 112. The second horizontal bar 210 is connected to a right-angle coupler 212, which is connected to a second vertical bar 214 that provides support for the red warning light 114. Accordingly, mounting plates 116 are attached to the first vertical bar 208 and the second vertical bar 214. This configuration is labeled the cross bar assembly 202.

An omni-directional speaker 122 is mounted to the tee-coupler 216. Two warning horns 220 and 222 are attached to support 106 by a mounting bracket 224. The warning horns 220 and 222 are placed at 180° apart from each other about the support 106. The placement of the warning lights 112 and 114, and the speakers 112, 220, and 222 should be implementation specific. The red warning light 114 should be placed at a higher elevation than the amber warning light 112. This is an alternative embodiment of the local area warning apparatus 250 and does not limit the scope of the present invention.

Figure 4:
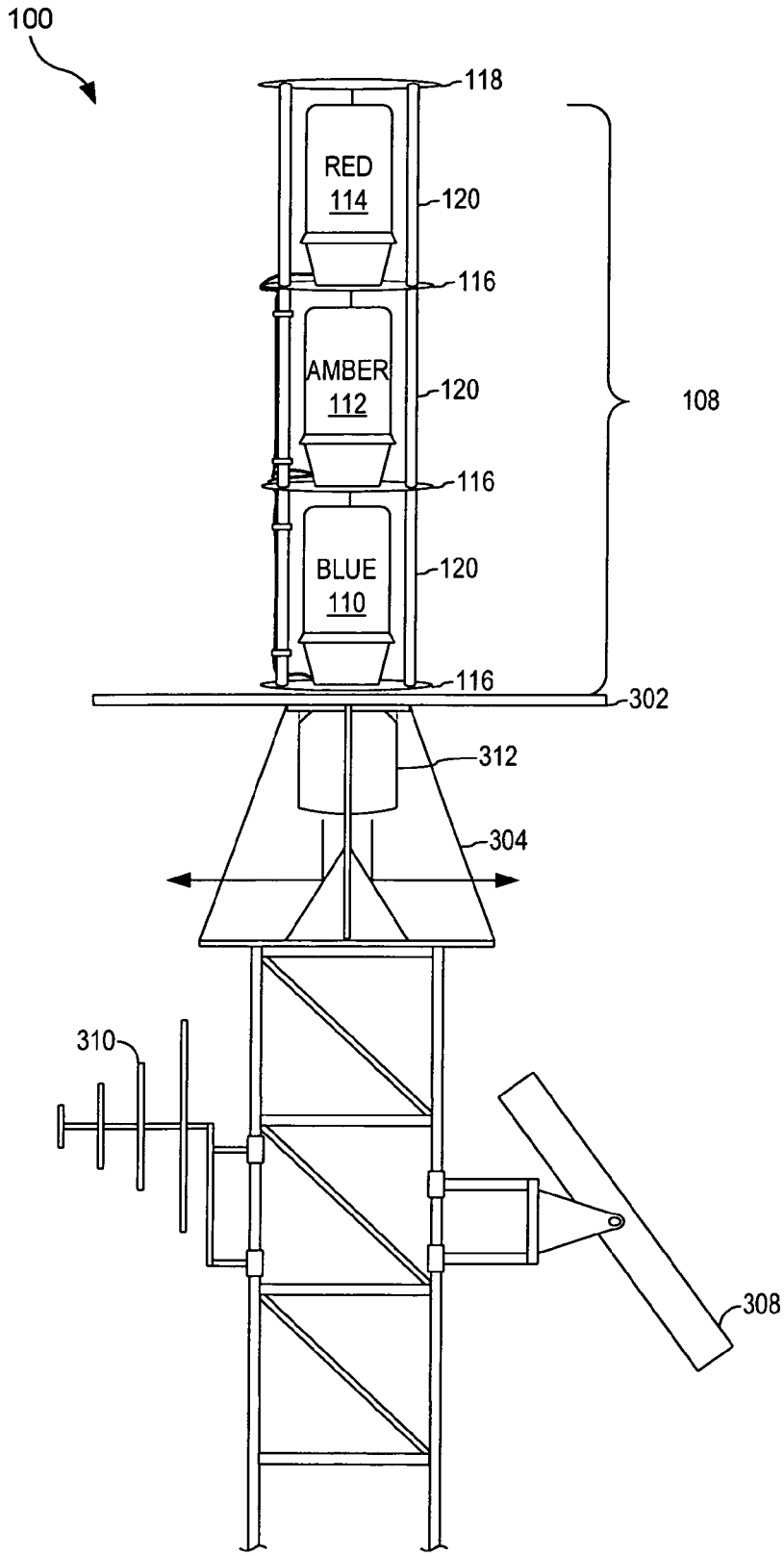
FIG. 4 is an alternative embodiment of the local area warning apparatus attached to a "Rohn 25G tower structure;"

FIG. 4 is an alternate embodiment of the local area warning apparatus 400 attached to a "Rohn 25G tower structure." This type of tower support 306 is provided by "Rohn Products." In a preferred embodiment, a 25G tower 306, which is available through Rohn Products at www.rohnproducts.com, is used to support this apparatus 400. This tower 306 provides more support in severe weather than the simple pole support 106 in FIG. 1. A tower 306 should be used when the warning lights 108 must be installed at a high location.

The warning lights 108 are described in detail with reference to FIG. 1. The warning lights 108 are supported by a hail-impact/UV radiation shield 302, which protects the speakers 312. The omni-directional sound reflectors 304 disperse the sound waves from the speakers 312 in all directions. Accordingly, the speakers 312 and the sound reflectors 304 should be configured to the characteristics of the surrounding environment and the public that must hear the weather alert. Many different combinations of speakers 312 and sound reflectors 304 may be used. The hail-impact/UV-radiation shield 302 should be large enough to protect the speakers 312 and the sound reflectors 304, but should not restrict the dispersion of the sound waves.

An antenna 310 is mounted to the tower structure 306. A directional gain antenna 310 is shown on this apparatus 300, but many different types of antennas may be used. A solar panel 308 is also mounted to the tower structure 306. The solar panel 308 is used to provide a power source. This type of a power source will be described in detail with reference to FIG. 7B. The receiver/electronics package ("box") 102 is not shown on this apparatus, but it resides lower on the tower 306. Accordingly, the antenna 310 must be connected to the receiver/electronics package 102.

Figure 5:
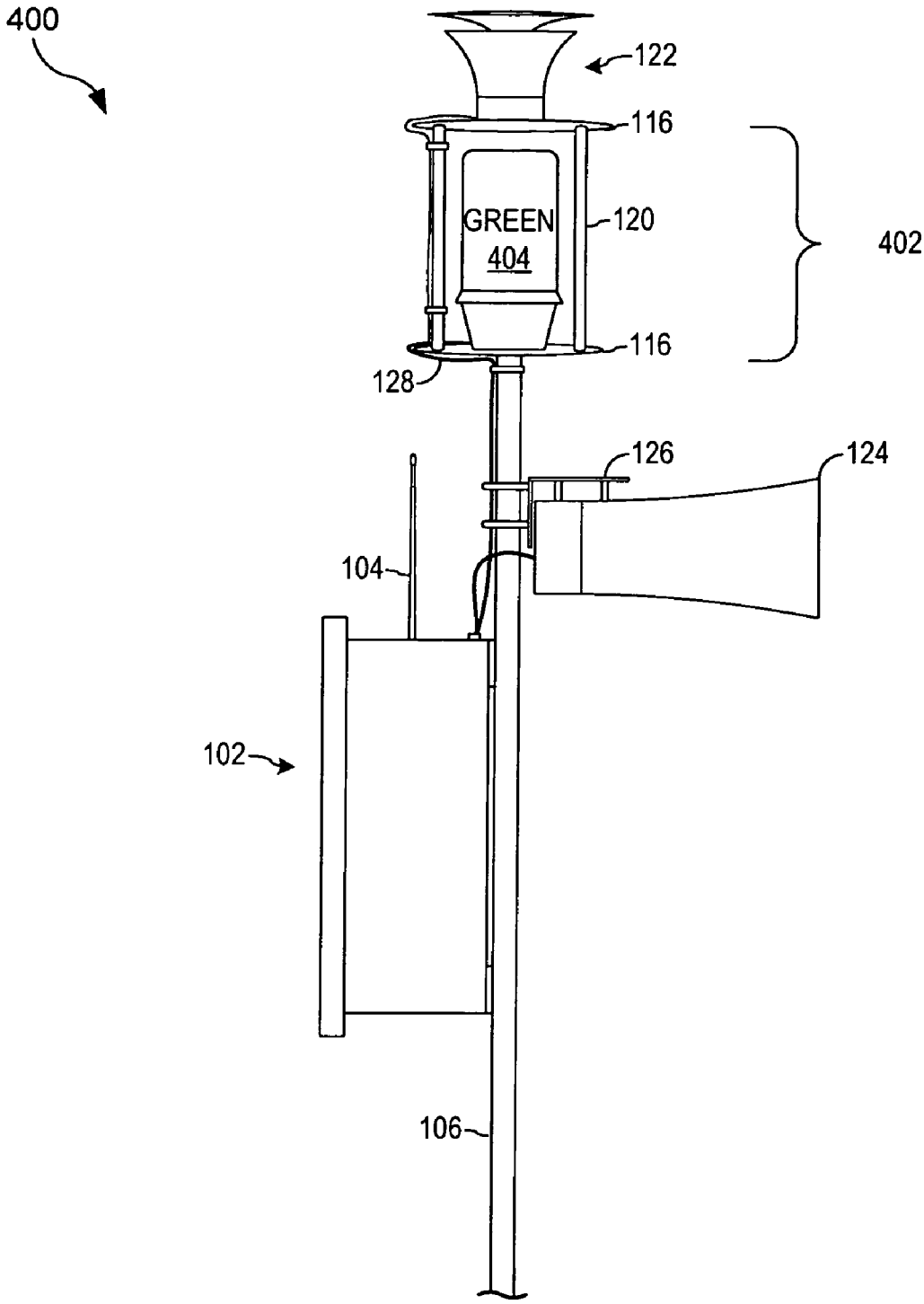
FIG. 5 is an alternative embodiment of the local area warning apparatus that is designed to notify the public of a safe shelter during a severe weather or technological condition.

FIG. 5 is an alternate embodiment of the local area warning apparatus 300 that is designed to notify the public of a safe shelter during a severe weather or technological condition. This shelter indication apparatus 400 has the same design as the local area warning apparatus 100 in FIG. 1, but with only one green warning light 404. The warning light housing 402 contains the green warning light 404, a mounting plate 116, a hail-impact/UV radiation shield 118, vertical supports 120 and cabling 128. The configuration of this apparatus is described in detail with reference to FIG. 1.

The green warning light 404 is used as an indication of a safe area. This local area warning apparatus 400 should be placed on top of a shelter, a bunker, or similar safe area. This way the public can easily find the safe area to migrate. In a preferred embodiment, this apparatus 400 receives and decodes the weather broadcasts from NWR. When NWR broadcasts a severe event, the green warning light 404 begins to illuminate. In addition, the speakers 122 and 124 should provide an audio message pinpointing the safe shelter, for the visually impaired or individuals that cannot observe the apparatus 400. This apparatus 400 should only illuminate when an event poses immediate danger to life, health, or property, and the public should seek a safe shelter. The green warning light 404 should only flash when it truly indicates a safe haven, such as high ground for a flood or an underground shelter for a tornado. Accordingly, the proper signage must be placed around both apparatuses 100 and 400 so that the public can understand the features of this local area warning system. Furthermore, many additional lights should be placed on or around this apparatus 400 so that the public can safely find shelter. In another embodiment, the local area warning apparatus 100 broadcasts the radio signal that induces the apparatus 400 to actuate the green warning light 404.

Figure 6:
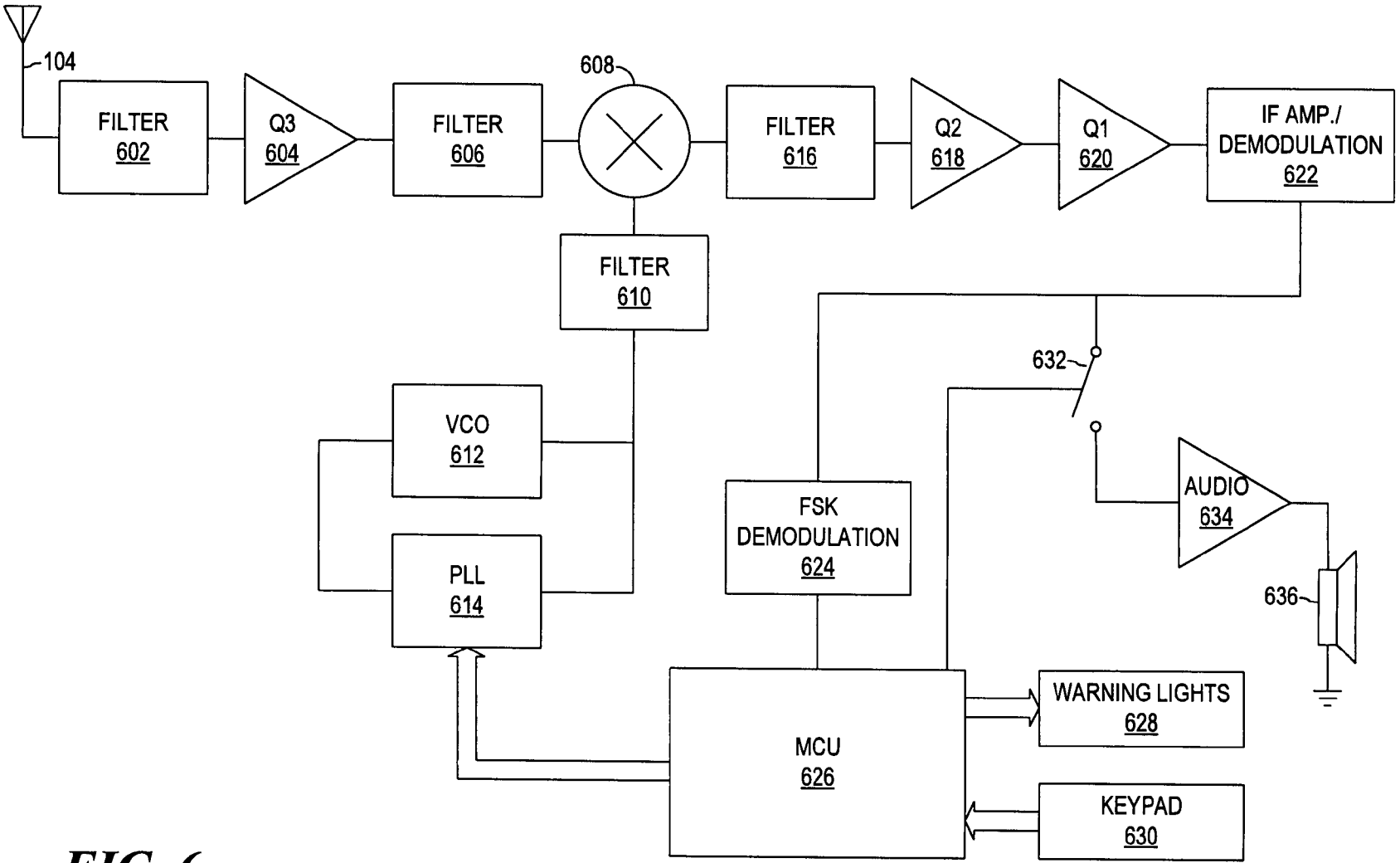
FIG. 6 is a block diagram illustrating the electronic configuration of the "RadioShack 7-Channel Weatheradio with NWR-SAME Severe-Weather Alert" device.

FIG. 6 is a block diagram illustrating the electronic configuration of the "RadioShack 7-Channel Weatheradio with NWR-SAME Severe-Weather Alert" device 600. This device is available through Radioshack at www.radioshack.com, and is only provided as an example of a receiver package. The receiver/electronics package 102 of FIG. 1 houses this device 600. The antenna 104, warning lights 628, and the speaker(s) 636 reside outside of the box 102. The NWR broadcast signal is received by the antenna 104. As previously described, the NWR broadcast signal is a radio frequency ("RF") signal on the VHF band. The RF signal (not shown) passes through a bandpass filter 602 and is then amplified by RF amplifier Q3 604. The amplified signal then passes through another tuned circuit filter 606 and is provided as an input to the mixer 608. A voltage controlled oscillator ("VCO") 612 is coupled to a phase lock loop ("PLL") 614. The VCO 612 and the PLL 614 provide the phase and frequency for the local oscillator signal. The micro control unit ("MCU") 626 controls the specifics of the local oscillator signal. The signal from the PLL 614 is filtered by filter 610 and also transmitted to the mixer 608.

The mixer 608 converts the RF signal and the local oscillator signal to an intermediate frequency ("IF") signal (not shown). The IF signal is filtered by bandpass filter 616. The IF signal is amplified and limited by IF amplifiers Q2 618 and Q3 620. The signal is then fed to the IF amplifier/ demodulator ("IFAD") 622, which produces a recovered audio signal. The output of IFAD 622 is connected to a switch 632 and a frequency-shift keying demodulator ("FSK") 624. FSK 624 provides the transformed broadcast signal to the MCU 626. The MCU 626 controls the PLL 614, the audio switch 632, and the warning lights 628. A keypad 630 is used to control the specifics of the device 600 through a connection to the MCU 626. For example, the keypad 630 can be used to input the county code for the location of the device, the volume of the speakers, the protocol of the warning lights, and the like. Providing a county code is only one mechanism to provide the location of the apparatus 100. An input of longitude and latitude coordinates can also be used to provide the location of the apparatus 100. Providing the location of the device ensures that the apparatus 100 only responds to NWR broadcasts for the specific area.

The MCU 626 decodes the signal from NWR and controls the warning lights 628 and the speaker(s) 636 accordingly. For example, if the broadcast signal declares a tornado warning, then the switch 632 closes and connects the IFAD 622 to the audio amplifier 634. The speaker(s) 636 uses the amplified IF audio signal to broadcast the NWR signal. The speaker(s) 636 can produce a loud siren or the words of the radio broadcast. Furthermore, during this tornado warning the MCU 626 illuminates the red warning light 114 of FIG. 1. The keypad 630 can control the response of the MCU 626 to specific events. For example, a user could program this apparatus 100 to produce the loud siren for 1 minute after a tornado warning, and then provide the specifics of the NWR broadcast for the next minute. A user can also program the warning lights 628 to illuminate for weather warnings in two counties if the apparatus is located close to the border of two counties. Accordingly, a computer software program can be implemented to accept these inputs and control the MCU in response to the user specifications. The location of the apparatus, the demographics of the public surrounding the apparatus, the natural environment, and the types of severe weather should be considered during programming.

In an alternative embodiment, a global positioning system ("GPS") device provides the county code or the specific location of the local area warning apparatus 100. The GPS device would prove to be beneficial for small mobile apparatuses 100. For example, this feature would ensure that the apparatus 100 would not have to be adjusted every time that a construction crew moved to an alternate job site.

Figure 7A:
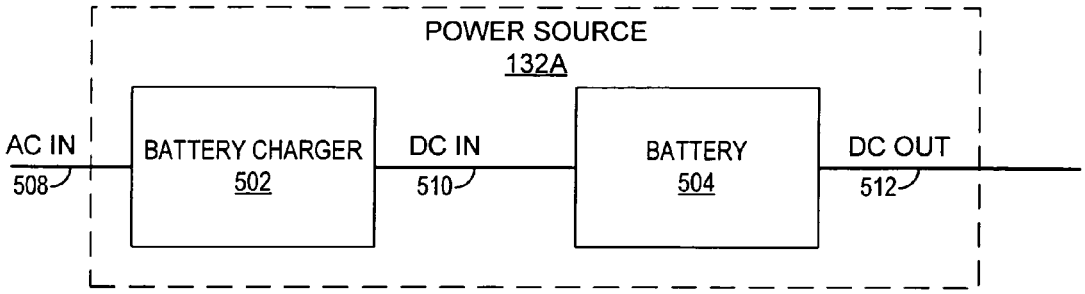
FIG. 7A is an embodiment of the power source for the local area warning apparatus.

FIG. 7A is an embodiment of the power source 132A for the local area warning apparatus. Power source 132A contains a battery charger 502 coupled to a battery 504. The battery charger 502 receives an AC power input 508 from a public utility source or a power generator. The battery charger 502 conveys DC power 510 to charge the battery 504. The battery 504 conveys DC power 512 to operate the local area warning apparatus 100.

Figure 7B:
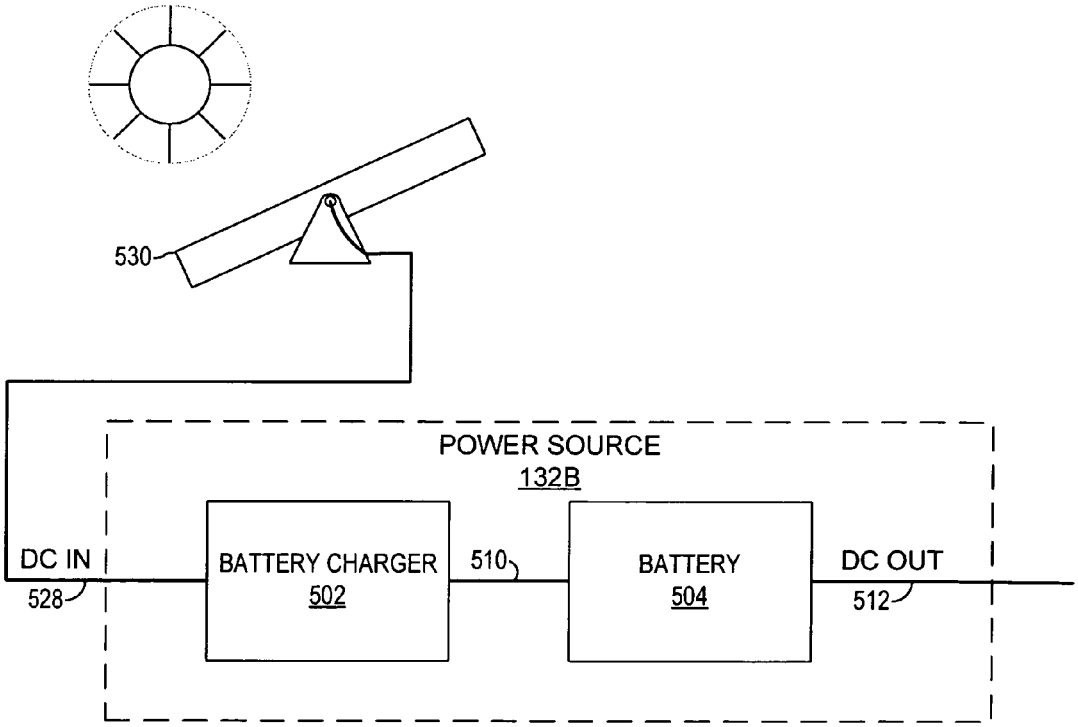
FIG. 7B is an alternative embodiment of the power source for the local area warning apparatus containing a solar powered panel.

FIG. 7B is an alternative embodiment of the power source 132B for the local area warning apparatus containing a solar powered panel. For this power source 132B a solar panel 308 provides the DC input power 528 to battery charger 502. This DC input power 528 can be provided by an array of photo-voltaic panels, a windmill generator, or any other "renewable" energy sources. Battery charger 502 provides the DC power 510 to charge the battery 504. The battery 504 provides DC power 512 to the local area warning apparatus.

Figure 7C:
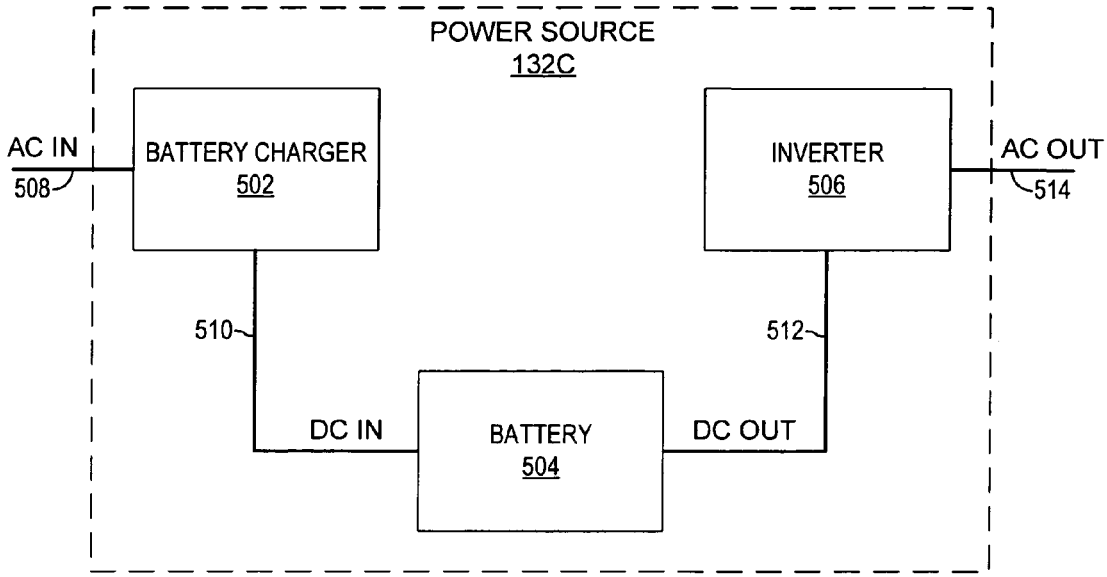
FIG. 7C is an alternative embodiment of the power source for the local area warning apparatus designed to produce an AC power output.

FIG. 7C is an alternative embodiment of the power source 132C for the local area warning apparatus designed to produce an AC power output. Power source 132C contains a battery charger 502 coupled to a battery 504. The battery 504 is coupled to a power inverter 506. The battery charger 502 receives an AC power input 508 from a public utility source or a power generator. The battery charger 502 conveys DC power 510 to charge the battery 504. The battery 504 conveys DC power 512 to operate the power inverter 506. Power inverter 506 provides AC power output 514 to the local area warning apparatus 100. Therefore, if AC input power 508 fails, power source 132A continues to provide AC power 514 to the local area warning apparatus 100 until the battery 504 is discharged.

Figure 7D:
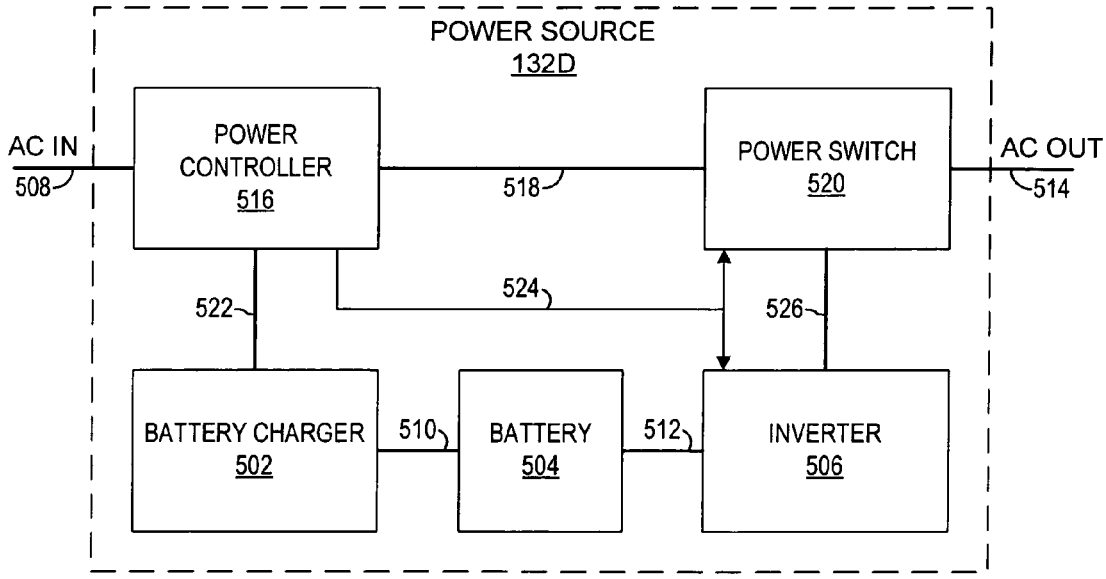
FIG. 7D is an alternative embodiment of the power source for the local area warning apparatus designed to produce an AC power output.

FIG. 7D is an alternative embodiment of the power source 132D for the local area warning apparatus designed to produce an AC power output. Power source 132D contains a battery charger 502 coupled to a battery 504, which is coupled to a power inverter 506, as shown in FIG. 7C. For power source 132D a power controller 516 receives the AC power input 508. The power controller 516 provides AC power 522 to the battery charger 502 to charge the battery 504. The power controller 516 also provides AC power 518 to a power switch 520. The power switch 520 provides AC power 514 to the local area warning apparatus 100. Therefore, under normal operation power controller 516 charges the battery 504 and provides the AC power 518 to the power switch 520.

If the AC input power 508 fails, power controller 516 senses the absence of AC power input 508, and sends a signal 524 to uncouple power switch 520 from AC power line 518 and to start inverter 506. Then the inverter 506 provides the AC power 526 to the power switch 520 and ultimately, to the local area warning apparatus 100. The inverter 506 and the battery 504 do not operate unless AC input power 508 fails, thereby prolonging the useful life of the inverter 506 and the battery 504.

FIG. 8 is an example of a local area warning system programming matrix. This programming matrix is designed for a mobile home park in Fort Worth, Tex. This programming matrix is only provided as an example of the flexibility of the present invention. Accordingly, the local area warning apparatus 100 can be specifically programmed for the type of severe weather conditions in a specific geographical area.

In Fort Worth, Tex. the severe weather conditions include tornados, severe thunderstorms, and floods. For this mobile home park the characteristics of this programming matrix would be input into the receiver/electronics package 102. Accordingly, the red warning light 114 would illuminate for a tornado warning, severe thunderstorm warning, or a flood warning. The amplified audio with alert siren (provided by the speakers) would project an alarm and the radio broadcast only for a tornado warning.

It is understood that the present invention can take many forms and embodiments. Accordingly, several variations of the present design may be made without departing from the scope of the invention. The capabilities outlined herein allow for the possibility of a variety of networking models. This disclosure should not be read as preferring any particular networking model, but is instead directed to the underlying concepts on which these networking models can be built.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A local area warning apparatus positioned in a public area for warning the public of actual or potential conditions, comprising:

a support structure;

at least one light secured to the support structure;

at least one speaker secured to the support structure;

a receiver/electronics package connected to the at least one light and the at least one speaker, which is located at the support structure and is at least configured to:

receive radio broadcasts pertaining to one or more geographical areas;

decode the radio broadcasts pertaining to a selected geographical area based on location codes in the radio broadcasts;

control the at least one light; and control the at least one speaker;

wherein the receiver/electronics package is enclosed within a protective enclosure and comprises an interface with an input device wherein the input device is configured to allow a user to:

input the selected geographical area of the apparatus;

program the at least one speaker to a specific volume setting; and program the at least one light to specific settings;

wherein in response to the decoded signals, the at least one light produces a visual message to the public relating to one or more actual or potential conditions associated with the selected geographical area; and wherein in response to the decoded audio signals, the at least one speaker produces an audio message to the public relating to one or more actual or potential conditions associated with the selected geographical area.

2. The apparatus of claim 1, wherein the input device is further configured to allow a user to:

program the at least one speaker to time settings.

3. An apparatus for broadcasting visual and audible warning indicia to the public, comprising:

a support structure;

one or more lights secured to the support structure;

a speaker for broadcasting a verbal message, the speaker being secured to the support structure; and a radio receiver connected to the one or more lights and the speaker that is located at the support structure, for receiving radio broadcasts, the receiver being configured to recognize the radio broadcasts as pertaining to a selected geographic location associated with placement of the support structure, based on signals indicating location in the radio broadcasts;

wherein the radio receiver comprises an antenna that is configured to receive the radio broadcasts and an interface with an input device and wherein the input device is configured to allow a user to:

input the selected geographical location of the apparatus;

program the speaker to specific volume and time settings; and program the one or more lights to specific settings;

wherein the one or more lights actuate in response to the radio broadcast received by the radio receiver to visually broadcast an alert relating to one or more actual or potential conditions associated with the selected geographic location;

wherein the radio speaker broadcasts in response to the radio broadcast received by the radio receiver, one or more verbal messages relating to the one or more actual or potential conditions associated with the selected geographic location;

wherein the at least a portion of each of the receiver, light and speaker are enclosed in a substantially weatherproof enclosure; and wherein the support structure, light and speaker are positioned in a public area.

* * * * *